United States Patent [19]

Grow

[11] Patent Number: 4,545,346

[45] Date of Patent: Oct. 8, 1985

[54] INTERNAL COMBUSTION HEAT ENGINE AND CYCLE THEREFOR

[76] Inventor: Harlow B. Grow, 16530 Chattanooga Pl., Pacific Palisades, Calif. 90272

[21] Appl. No.: 477,533

[22] Filed: Mar. 21, 1983

[51] Int. Cl.[4] ..... F02B 33/04

[52] U.S. Cl. ..... 123/305; 123/317; 123/73 R; 123/65 VD

[58] Field of Search ..... 123/305, 73 R, 73 C, 123/73 PP, 318, 73 A, 73 AB, 73 CB, 73 V, 65 VD, 65 VC, 317

[56] References Cited

U.S. PATENT DOCUMENTS

| | | | |
|---|---|---|---|
| 2,246,446 | 6/1941 | Kylen | 123/73 AB |
| 2,256,437 | 9/1941 | Kylen | 123/73 AB |
| 3,613,646 | 10/1971 | Hisada | 123/73 R |
| 4,070,998 | 1/1978 | Grow | 123/26 |
| 4,242,993 | 1/1981 | Onishi | 123/73 R |

*Primary Examiner*—Craig R. Feinberg

*Assistant Examiner*—David A. Okonsky

*Attorney, Agent, or Firm*—William H. Maxwell

[57] ABSTRACT

An internal combustion heat engine and cycle therefor comprising a two stroke cylinder and piston unit having a combustion chamber at the top of the cylinder, having a compression chamber at the bottom of the cylinder, and having a transfer chamber charged with compressed combustion support air transferred into the combustion chamber during initial movement of the piston in a first power stroke, followed by spark ignition and combustion to effect said power stroke with simultaneous compression in said compression chamber and with admission of compressed combustion support air into said transfer chamber during terminal movement of said power stroke, the compressed combustion support air being stored in the transfer chamber during a second exhaust stroke with simultaneous induction of air into the compression chamber.

12 Claims, 8 Drawing Figures

FIG. 1. (EXHAUST-INTAKE)
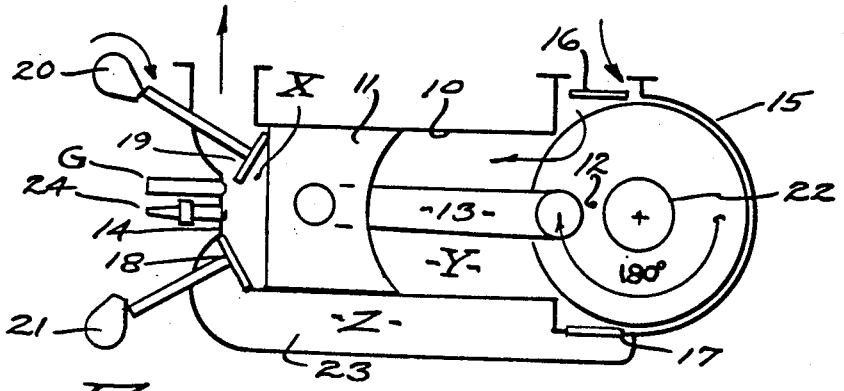
FIG. 2. (TRANSFER)
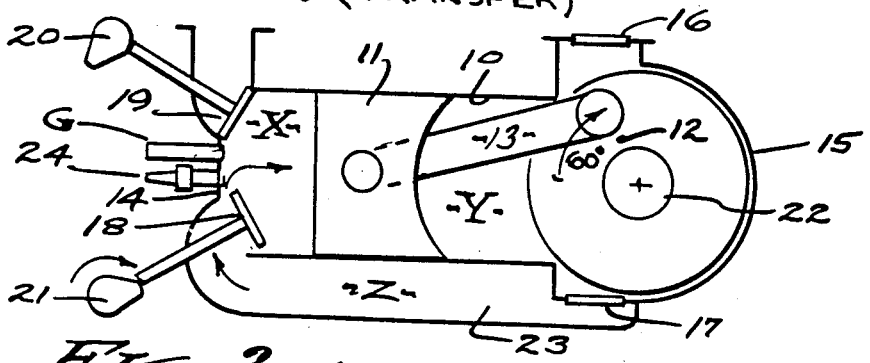
FIG. 3. (POWER-COMPRESSION)
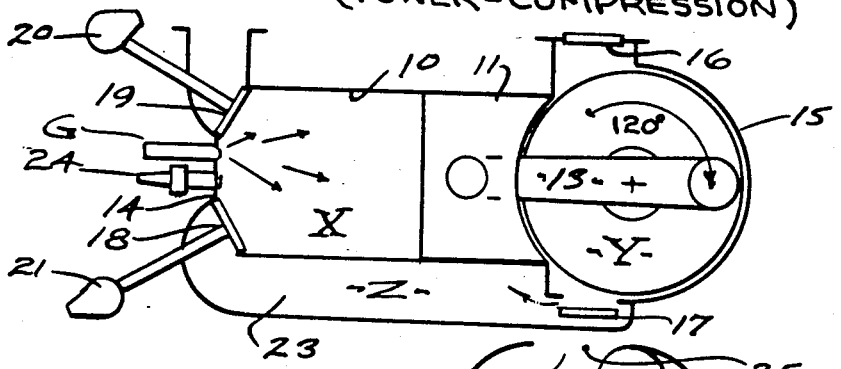
FIG. 4. (STORAGE)
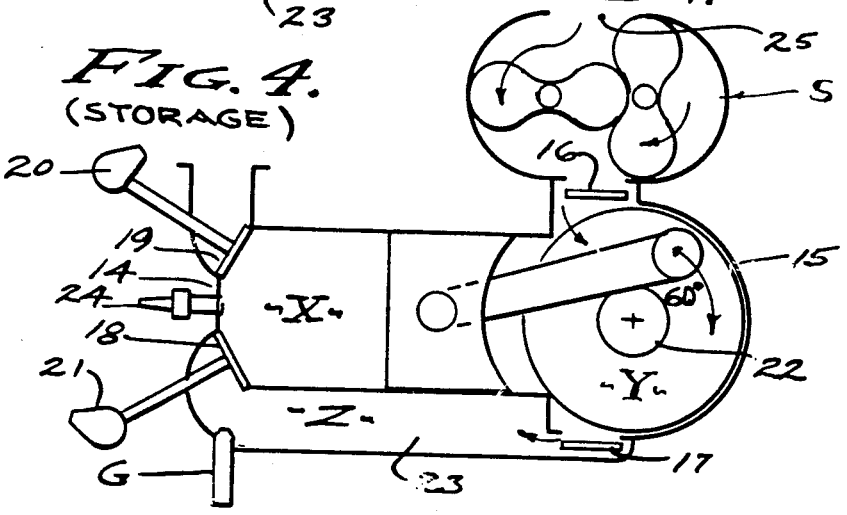

INTERNAL COMBUSTION HEAT ENGINE AND CYCLE THEREFOR

BACKGROUND

Heat engines are known to operate on differing principles and among which are the Rankine steam cycle, and the Otto and Carnot internal combustion cycles. The Rankine cycle engines are known for their high torque characteristics particularly when starting, while the Otto (gas) and Carnot (Diesel) cycle engines rely upon inertia and require substantial momentum in order to produce high torque. Furthermore, Otto and Carnot cycle engines are either four stroke or two stroke, the latter having its operational limitations, whereas the Rankine cycle engines of the reciprocating type produce full power with each stroke regardless of speed (within practical limits). However, with the present invention, it is a hybrid heat engine cycle that is provided wherein two strokes are involved and essentially two cycles, to be known as the Two Stroke Grow Cycle, it being a general object of this invention to provide a high torque high efficiency heat engine of the internal combustion type.

For the purpose of this invention, pressure volume curves are to be read in light of torque characteristics, it being known that the expansion of steam in a cylinder produces superior torque, as compared with known four and two stroke internal combustion engines. With Otto cycle gas engines the induction of air and fuel must have the proper stoichiometric ratio compressed before spark ignition, and the explosive charge ignites when the crank is at a rotational position of disadvantage at or near Top Dead Center. With Carnot cycle Diesel engines the induction air is compressed and the fuel injected for subsequent burning, and again the charge commences its burn when the crank is at a rotational position of disadvantage at or near Top Dead Center. It is an object of this invention to provide a heat engine cycle wherein air induction and fuel injection is transferred into a cylinder when the down-stroke commences and followed by a burning of fuel approximating the performance of the Rankine cycle with the crank at a rotational position of advantage angularly advanced from Top Dead Center.

With the present invention, a downward acting piston compresses combustion air at one end of the cylinder and which is stored in a transfer chamber and subsequently released into the other end of the cylinder when the piston retracts to receive the compressed combustion air. Fuel is either injected along with the transfer of compressed combustion air as in an Otto cycle arrangement, or is injected after the transfer of compressed combustion air as in a Diesel cycle arrangement. In either arrangement, the crank position of the engine is well advanced away from Top Dead Center when combustion is initiated by spark under heat of compression.

This is a cylinder and piston internal combustion heat engine wherein compression is attained during the power stroke, and wherein intake of combustion air occurs during the exhaust stroke, a two cycle or two stroke engine, it being an object of this invention to provide such an engine with induction air transfer means by which high performance is achieved through torque applied to advanced positioning of the engine crank. It is an object of this invention to compress induction air during the power stroke, and to store compressed induction air during the exhaust stroke. It is also an object of this invention to transfer compressed induction air with or without a fuel admixture into the combustion chamber of the cylinder. It is still another object of this invention to delay ignition for advancement of the piston into a position of great mechanical advantage for the efficient application of torque. And it is also an object of this invention to control induction air compression by supercharging where circumstances require.

The engine of the present invention is a departure from both the Otto (gas) and Carnot (Diesel) cycle concepts and is more analogous to the Rankine (steam) cycle, in that full volume compression and measured fuel injection at the beginning of the power stroke is avoided. Replacing the foregoing is controlled injection as it is disclosed in my U.S. Pat. No. 4,070,998 entitled Compression Ignition Controlled Pressure Heat Engine, issued Jan. 31, 1978. To this end it is an object of this invention to continuously inject fuel in a double acting two cycle engine throughout the most effective portion of the work stroke, and at a controlled rate to support combustion within the cylinder.

An object of this invention is to advantageously employ the constant volume variable potency injectors as disclosed in U.S. Pat. Nos. 3,749,097 and 3,921,599 issued to me on July 31, 1973 and Nov. 25, 1975 respectively. It is by means of these fuel injectors, or like injectors, that controlled fuel burning and cylinder pressures are maintained as may be desired. With this invention a constant volume pump intermixes two liquids and discriminately injects the admixture thereof discretely therefrom and into the engine cylinder at a controlled potency. The injector per se is characterized by its differential pump means which are advantageously employed to acquire structural strength and accurately metered fuel injection.

SUMMARY OF INVENTION

This invention relates to internal combustion heat engines having a cycle of operation that differs from the Otto and Carnot cycles, and which is more analogous to the Rankine cycle by virtue of its prolonged burning capability applied from a piston position substantially advanced from Top Dead Center position of the engine crank, but not to exclude free piston engines. In practice, there can be a multiplicity of cylinder and piston units, and each of which is a double acting two stroke unit with compression of induction air at one side of the piston and with expansion of working fluid at the other side of the piston. A feature is the transfer chamber in which compressed induction air is stored and from which it is transferred into the combustion chamber of the cylinder at ignition supporting pressure. As shown, the induction of air and compression thereof occurs during the first cycle or power stroke, by means of a crankcase compressor controlled by poppet valves; and which can be supercharged. Another feature is transfer of compressed induction air through a timed valve to fill the combustion chamber at ignition supporting pressure as the piston withdraws from Top Dead Center position to a predetermined advanced position of crank rotation where ignition is initiated by discharge of a spark, followed by continued burning to complete the first cycle power stroke. Exhaust is through a timed valve during intake, these two functions occuring at opposite ends of the cylinder during the second cycle of engine operation.

The foregoing and various other objects and features of this invention will be apparent and fully understood from the following detailed description of the typical preferred form and applications thereof, throughout which description reference is made to the accompanying drawings:

THE DRAWINGS

FIG. 1 is a schematic view showing the basic engine elements as they are related during the exhaust and intake cycle of operation.

FIG. 2 is a schematic view showing the basic engine elements as they are related during the beginning of the power stroke of operation, illustrating the transfer of combustion air stored under compression.

FIG. 3 is a schematic view showing the basic engine elements as they are related during the torque effective portion of the power stroke, illustrating the compression of combustion air into the storage chamber.

FIG. 4 is a schematic view similar to FIG. 2 showing a second form of the invention having fuel injection through the intake valve and showing supercharging, and illustrating the crank at about the point of admission of working fluid into the transfer chamber.

Figure 8:
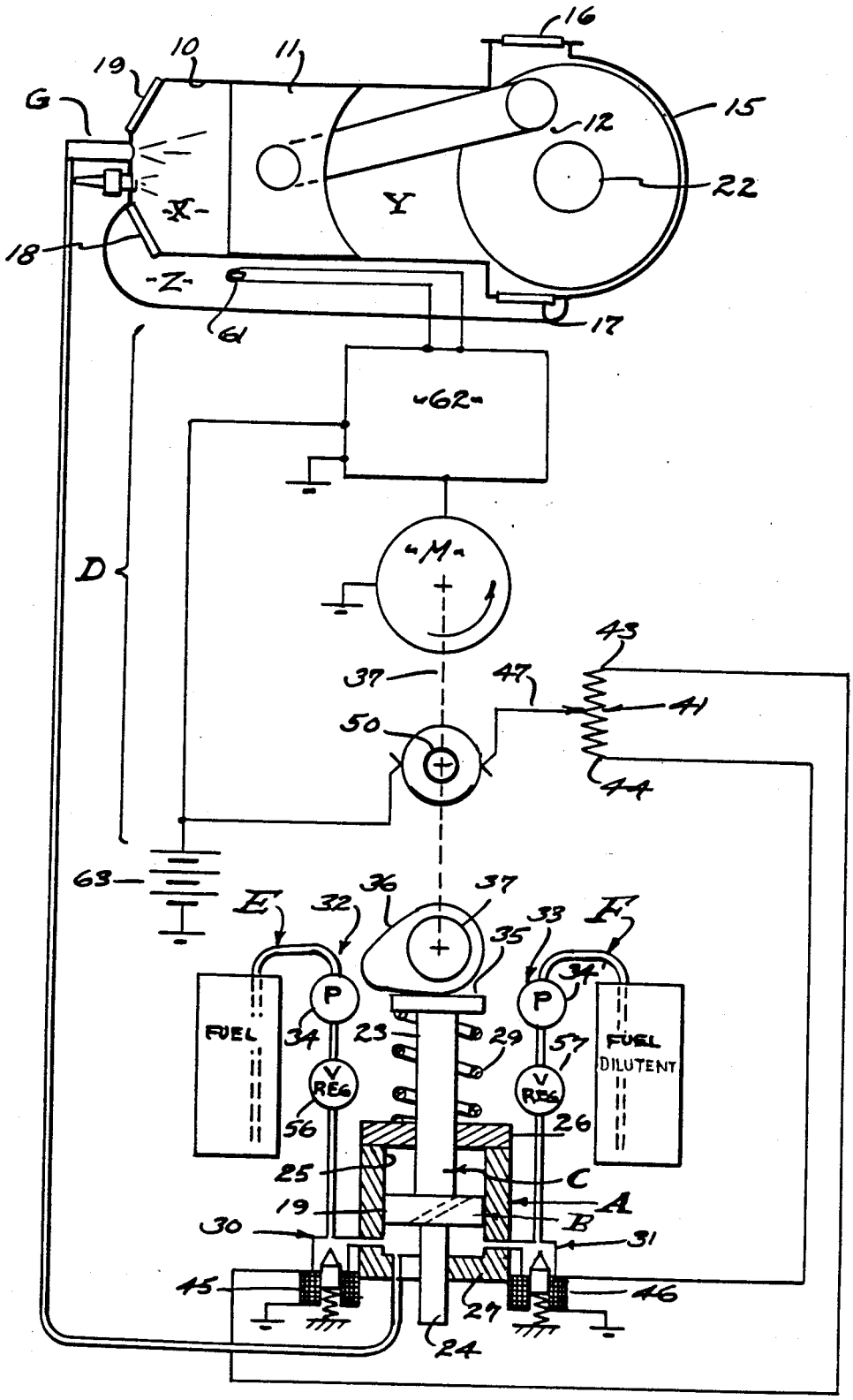

And, FIG. 8 is a schematic diagram illustrating the full stroke fuel pump means.

PREFERRED EMBODIMENT

Figure 5:
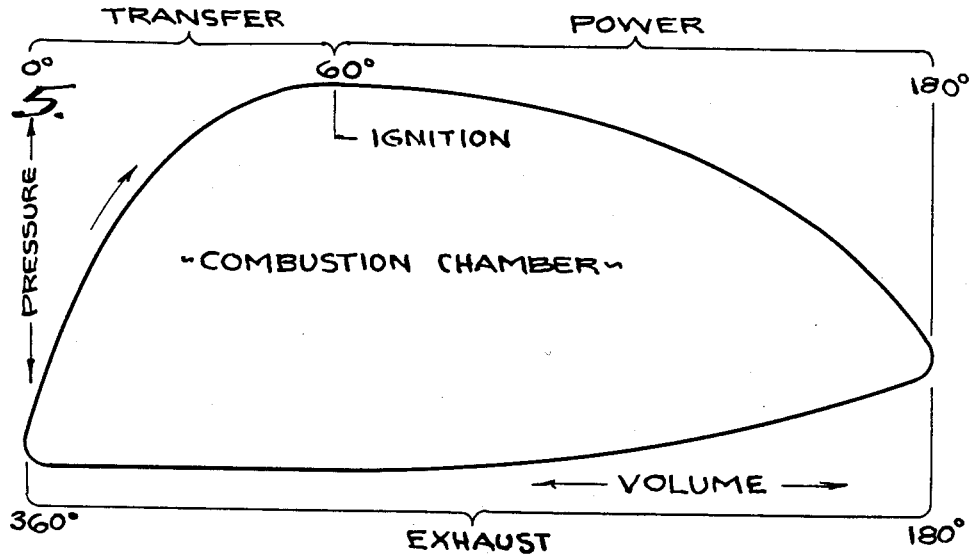
FIG. 5 is a Pressure Volume diagram for the combustion chamber of the engine, illustrating the transfer function, power function and exhaust function thereof.
Figure 6:
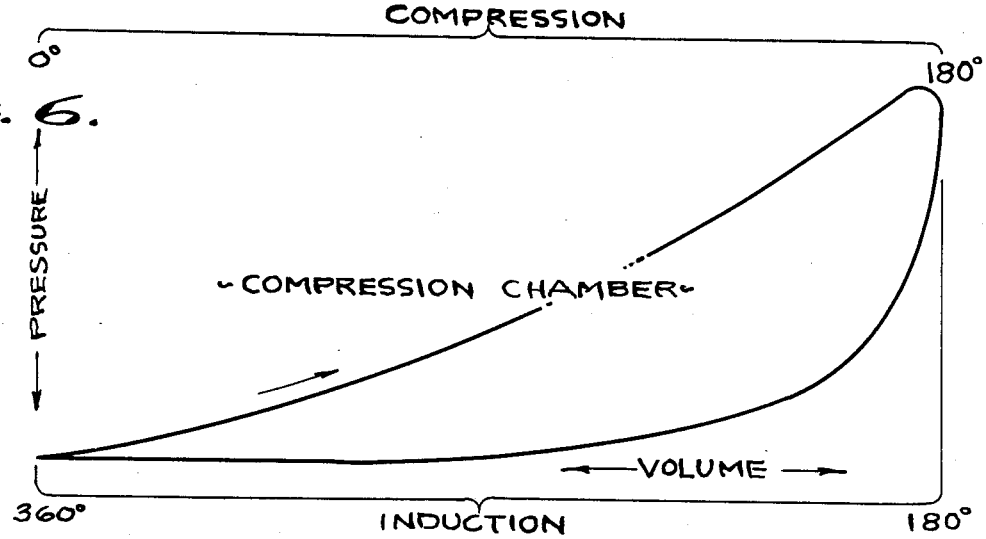
FIG. 6 is a Pressure Volume diagram for the compression chamber of the engine, illustrating the induction function and compressive function thereof.
Figure 7:
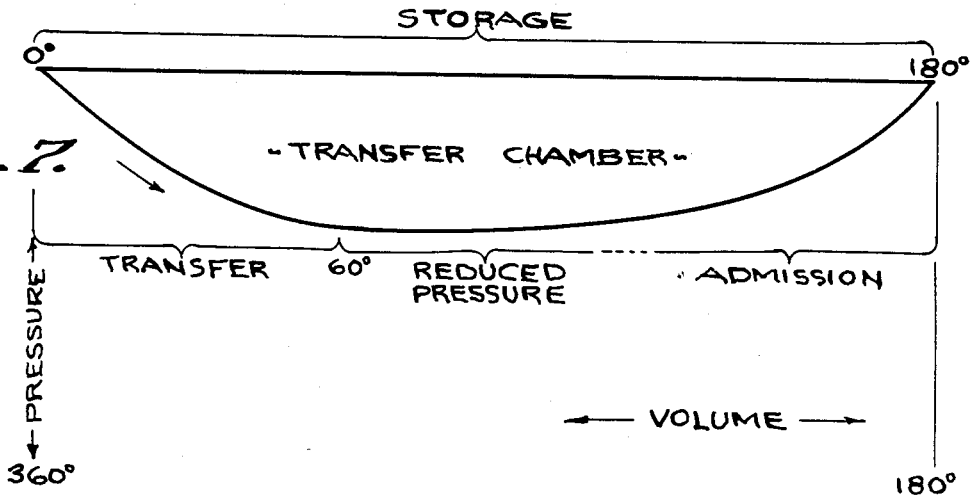
FIG. 7 is a Pressure Volume diagram for the transfer chamber of the engine, illustrating the admission function and discharge function thereof.

The engine of the present invention involves three chambers in carrying out the two cycles of engine operation, a combustion chamber X, a compression chamber Y, and a transfer chamber Z. Accordingly, there are necessarily three Pressure Volume diagrams to be considered in the process and/or heat engine cycle and which are shown theoretically as FIGS. 5 and 6 and 7 of the drawings. FIG. 5 illustrates those functions which affect engine operation in the combustion chamber X; FIG. 6 illustrates those functions which affect engine operation in the compression chamber Y, and FIG. 7 illustrates those functions which affect engine operation in the transfer chamber Z. The combustion air transfer function and power function in chamber X take place successively during what will be termed cycle one, and the exhaust function from combustion chamber X takes place during what will be termed cycle two. The compression of combustion air function in compression chamber Y takes place during cycle one, and the induction function into compression chamber Y takes place during cycle two. The transfer function of compressed combustion air from the storage chamber Z into the combustion chamber X takes place during the beginning of cycle one, the storage function of compressed combustion air into the transfer chamber Z takes place during the termination of cycle one, and the storage function of compressed combustion air within transfer chamber Z takes place during cycle two. Though the engine schematics and Pressure Volume diagrams are shown disposed horizontally herein, cycle one will be termed the power stroke or "down" stroke, and cycle two will be termed the exhaust stroke or "up" stroke.

Referring to schematic FIGS. 1, 2 and 3 of the drawings, the two stroke engine of the present invention involves, generally, a compound or double acting cylinder and piston unit comprised of a cylinder 10 in which a piston 11 reciprocates between Top Dead Center and Bottom Dead Center positions as determined by a crank 12 to which it is coupled by a connecting rod 13. One end or top of the cylinder is closed by a head 14 to define the combustion chamber X, and the other end or bottom of the cylinder is closed by a case 15 to define the compression chamber Y and in which the crank 12 revolves coupled to the piston 11 by said connecting rod 13.

Intake of combustion air is into the compression chamber Y of crank case 15 through an intake poppet valve means 16, and discharge of combustion air from the crank case 15 is through a storage poppet valve means 17. The poppet valves 16 and 17 can be mechanically timed and thereby opened and closed, however they are preferred to be simple self opening and closing check valves as indicated and with spring closure means (not shown) according to the state of the art. Intake of combustion air is into the combustion chamber X of cylinder 10 through a timed transfer poppet valve means 18, and exhaust of combusted gases from the cylinder 10 is through a timed exhaust poppet valve means 19. The transfer and exhaust valves means 18 and 19 are timed, according to the state of the art as by camshafts 20 and 21 driven from the crankshaft 22 by gears or chains, or belts (not shown). In accordance with this invention, there is a confining passageway 23 having a displacement for the storage of a charge of compressed combustion air, extending from poppet valve means 17 to poppet valve means 18 and which defines the transfer chamber Z. The transfer chamber Z operates at and above the combustion supporting pressure transferred into combustion chamber X.

The engine unit thus far described is timed for two stroke operation so that the combustion chamber X thereof exhibits the characteristics depicted in the Pressure Volume diagram of FIG. 5 of the drawings. To this end for example, the transfer poppet valve means 18 opens at or about Top Dead Center position so as to admit a charge of compressed combustion air into the combustion chamber X from the transfer chamber Z. It is significant that transfer of this working fluid from chamber Z into chamber X takes place during initial downward movement of piston 11, whereby cylinder volume is gradually increased to accept a determined volume of said fluid. According to the diagram for example, the transfer poppet valve means 18 closes at or about 60° after Top Dead Center position where ignition is to commence, followed by 120° of torque producihg stroke and thereby completing cycle one at or about Bottom Dead Center position, at which point the exhaust poppet valve means 19 opens for the duration of cycle two to follow. At the end of the second stroke of cycle two the exhaust poppet valve means 19 again closes for the duration of the subsequent first cycle above described.

The introduction of fuel for combustion is either by fuel injection as shown in FIG. 4 of the drawings or by constant volume variable potency fuel injection means and shown in FIGS. 1 to 3 and later described with respect to FIG. 8. With the fuel injection of FIG. 4, a volitile or aromatic fuel such as gasoline or the like is atomized by a nozzle G through the opening of transfer poppet valve means 18, whereby the transferred volume of compressed combustion air is charged with a combustible admixture. Fuel injection is timed with respect to piston position by crankshaft 22 driven means (not shown) according to the state of the art.

In accordance with this invention, there is spark ignition as and when valve means 18 closes at or about 60° after Top Dead Center position, in order to effect the torque producing portion of the power stroke of piston 11. As shown, there is a spark plug 24 exposed into the combustion chamber X and timed with respect to piston position by crankshaft 22 driven ignition and distributor means (not shown), according to the state of the art.

Simultaneous with the transfer-combustion-exhaust cycles of operation, the compression chamber Y exhibits the characteristics depicted in the Pressure Volume diagram of FIG. 6 of the drawings. As is indicated, the intake poppet valve means 16 opens at or about Top Dead Center position so as to admit outside ambient air to enter into the crank case 15 and compression chamber Y defined thereby. Poppet valve means 16 is a check valve that opens into case 15 and chamber Y during the up stroke of cycle two, and that closes during the down power stroke of cycle one for compression of induction air and its subsequent pumping into the transfer chamber Z through the storage poppet valve means 17. Accordingly, poppet valve means 17 opens when the pressure in chamber Y reaches and exceeds the pressure in chamber Z, and it closes at or about Bottom Dead Center position. Thus, the chamber Y establishes an air induction pump for charging the transfer chamber Z next described.

Simultaneous with the aforementioned combustion chamber X and compression chamber Y functions above described, the transfer chamber Z exhibits the characteristics depicted in the Pressure Volume diagram of FIG. 7 of the drawings. As is indicated, the storage poppet valve means 17 opens from compression chamber Y and into transfer chamber Z when the pressure in the former reaches the partially depleated pressure in the latter. After maximum induction compression is reached at Bottom Dead Center position, the storage poppet valve means 17 automatically closes and the compressed combustion air entered into transfer chamber Z becomes stored until the timed transfer poppet valve means 18 opens at or about Top Dead Center position, in order to effect the first described transfer of the working fluid into the combustion chamber X. As shown in the diagram of FIG. 7 the partially depleated storage fluid pressure remains in chamber Z until supplemented by the admission of higher pressures at the terminal portion of the occuring power-compression stroke. Accordingly, the transfer chamber Z pressure fluctuates between pressures at and above combustion supporting pressure.

The engine of the present invention is characterized by the build-up of combustion air stored under pressure in the transfer chamber of restricted displacement adapted to retain combustion supporting pressures and temperature for short durations of time. The compression ratio of induction air entering chamber Y is commensurate with that required to support combustion in combustion chamber X, said compressed induction air being stored momentarily during the exhaust stroke of cycle two and then transferred into the cylinder 10 at the beginning of the power-compression cycle one.

In the event that it is desired to increase the aforesaid compression ratio, the pressure of ambient air is increased at the intake poppet valve means 16, and in accordance with this invention the induction air is supercharged by a blower means or pump S. The pump S is driven by the engine exhaust or shaft 22 in a manner according to the state of the art. As shown, the pump S receives ambient air through an inlet 25 and delivers it in a compressed condition through the storage poppet valve means 17. In practice, the pump S can be a "Roots" Blower as shown.

Referring now to FIG. 8 of the drawings and to the constant volume variable potency fuel injection, a constant stroke and constant volume differential ram pump is operated in timed relation to the engine piston reciprocation. The injection functions are: low pressure metering and homogenous mixing together of discretely small amounts of at least two liquid fuels, one of maximum potency and one of lesser or minimum potency such as a dilutant and/or other additive as may be required, the averaging of power through multiple power strokes, and the constant volume injection which results in full stroke fuel injection and reduced peak pressure; all of which is due to the controllability of relatively small discrete amounts of liquid to be injected. Fuel is injected constantly throughout the effective work stroke of the piston.

The constant volume injection principle is utilized herein, to the end that the Pressure Volume power curve of the engine is controlled, and as a consequence making it possible to control cylinder 10 pressure. The injected fuel is a homogenous mixture of at least two liquids, one such as oil or fossil fuel with its full compliment of constituents and properties which afford a maximum power potential commonly rated in British Thermal Units, and one such as water (preferably treated, for example modified or pure or distilled water) with its lesser potency or inert or partially inert properties insofar as combustibility is concerned. In addition to the use of fossil fuels mixed with water, I contemplate the mixture of alcohol and like fuels with water; wherein the water-alcohol will serve as the idling mixture and will have anti-freeze properties. The potency of each power injection is averaged whereby sudden changes are made impossible, while the fuel potency increase or decrease is effected without unreasonable delay, by design in proportioning the differential pump ram as related to the cylinder displacement into which the fuel is injected, and all to the end that peak pressures are reduced so that lighter weight engine structures become permissible, while increasing the potential power output through all speed ranges due to the closer realization of a constant pressure cycle.

Each pumping device involves a pump cylinder A, a partition B separating the cylinder into dual chambers, a differential ram C entering the dual chambers respectively and positioning the partition B in the cylinder A, sensor means D driving the same in timed relation to reciprocation of the engine piston 11, a metered fuel supply means E, a metered fuel dilutant supply means F, and a valved injector means or nozzle G opening into the engine cylinder.

The dual chambers are, a transfer chamber in which the fuel and fuel dilutant are mixed, and a storage chamber in which fuel mixture not injected is re-mixed and stored. The re-mixing and storage concept provides for an averaging of fuel-dilutant potency over a number of engine cycles dependent upon the swept volumes of the said chambers. In practice, the transfer chamber which receives and delivers fluids can have a substantially complete swept volume, whereas the storage chamber which stores previously metered fuel and fuel dilutant has a remaining unswept volume thereby holding consecutively metered charges of fuel-dilutant mixture or portions thereof and mixing and averaging them over a number of engine piston reciprocations.

The pump cylinder A has an inner diameter wall 25 accurately turned about a central axis, the cylinder opening having substantial length and closed at opposite ends by heads 26 and 27, at least one of which is removable for disassembly. The partition B is preferably a piston that is operable in the cylinder A and has an outer diameter wall 19 accurately turned about the central axis and of substantially lesser length than the distance between the heads of the cylinder. The differential ram C that enters the cylinder A is effective in its movement upon the fluids in the aforementioned dual chambers, having differentially sized ram pistons 23 and 24 operable through the heads 26 and 27.

The sensor-drive means D operates the ram C in timed relation to reciprocation of the engine piston 11 and is shown as a piston proximity sensor and motor tappet drive. Sensor probes are located at each combustion chamber X, in the form of a coil 61 that is exposed to the proximity of the piston 11. The sensor-drive means is shown as being electronic, with sensor coil 61 juxtaposed to the piston head closely approaching and/or passing thereby to cover the same. The coil 61 senses the reciprocal positions of the piston 11, at or about the Top Dead Center position in each instance and at which position fuel injection is to be initiated. Accordingly, there is an electronic timer means 62 energized by a power supply 63 such as a battery, and which is responsive to the reciprocal position of the piston 11 as sensed by the coil 61 so as to generate power pulses or the like for driving a motor M at an angular momentum rate commensurate with reciprocal movement of the said engine piston 14. The motor M is of the synchronous type, a Selsin motor or stepper motor actuated in timed relation to pulses or the like generated by the timer means 62, and turning a shaft 37 of the injector means Z to revolve an injector cam 36 and contactor 50, as will be described.

The ram C has a tappet 35 to engage and follow the cam 36 that revolves with the motor driven shaft 37 at synchronous speed, two cycle timing responsive to the sensor-drive means D as above described. It will be apparent how the lobe of the cam 36 shifts the tappet 35 so as to project the larger ram piston 23 of differential ram C into the uppermost chamber and thereby move the partition B so as to augment said uppermost chamber while diminishing the lowermost chamber while the total displacement is diminished. A return spring 29 returns the tappet, a characteristic feature being control by the shape of cam 36 which is designed to inject fuel at a rate to establish the desired cylinder pressure curve. The rate of injection as determined by the shape of cam 36 will vary with engine design.

The metered fuel supply means E and metered fuel dilutant supply means F operate cooperatively to supply or replenish a full injection charge to the uppermost chamber following each constant volume injection therefrom. To this end, the means E involves a valve 30 adapted to intermittently admit fuel, and the means F involves a valve 31 adapted to intermittently admit fuel dilutant. Essentially, the valves 30 and 31 are alike and are opened in inversely balanced degree or for variably balanced time intervals; all for the purpose of completely replenishing the augmenting lowermost chamber. Accordingly, the means E supplies fuel, for example oil, from a constant pressure supply 32; while the means F supplies dilutant for example inert liquid such as mineral oil or water, from a constant pressure supply 33. Depending upon the liquid viscosities involved, the said constant pressures are set at suitable levels and/or the liquids are supplied through orifices of suitable diameter.

Constant pressure is established by means of pumps 34 and 34' that deliver the liquids through pressure regulators 56 and 57 respectively. The amount of delivered liquid in each instance can vary according to the time during which the valves 30 and 31 are fully opened. An electrical potential applied to retract the needle of valve 30 from the valve seat and against a return spring 42 opens each valve inversely varied amounts. The said electrical potential is controllably determined by a rheostat 41 wherein the opposite terminals 43 and 44 of the resistance are connected to valve opening solenoids 45 and 46 respectively, and wherein the moving contact 47 thereof operates between the said terminals. A contactor 50 revolves with the shaft 37 and cam 36 and which conducts current during the intake stroke of the differential ram C and partition B.

The valved injector means G involves a nozzle that opens into the engine cylinder 10 and into the combustion chamber X thereof, and has a check valve (not shown) that prevents the return of fuel-dilutant mixture into the injector. Consequently, the delivery is forward at all times through a tube or the like which delivers a suitably potent charge into the engine cylinder for burning.

From the foregoing it will be understood that a unique heat engine cycle is provided, embodied in a two stroke cylinder and piston internal combustion heat engine. Generally, power and compression is simultaneous, while exhaust and induction are also simultaneous. These relationships of power-compression-exhaust-induction are made possible by the provision of the transfer chamber in which compressed combustion support air is stored and transferred into the combustion chamber. A feature is the advanced positioning of the piston and crank from Top Dead Center when the spark ignition occurs, and it is highly important and very significant that fuel injection continues at variable potency during a substantial portion of the power stroke. And, it is also significant that combustion support air is stored at higher than combustion support pressure, in order to expand by being drawn into the combustion chamber by the piston moving from the Top Dead Center position.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. An internal combustion heat engine cycle for a reciprocating engine unit, and including;

admitting intake air into a separate compression chamber continuously during a full stroke of a piston, charging a transfer chamber with compressed combustion support air from the compression chamber and storing it therein during a first power stroke of the piston, transferring a portion of the compressed combustion support air from the transfer chamber and into a combustion chamber during the initial portion of first power stroke of the piston, injecting fuel into the combustion chamber to admix with the compressed combustion support air transferred therein, igniting the admixture of fuel and compressed combustion support air to effect the first power stroke of the piston, and discharging burnt gases from the combustion chamber while simultaneously admitting the aforesaid intake air into the compression chamber during a second reciprocal exhaust stroke of the piston.

2. The heat engine cycle as set forth in claim 1, wherein charging of compressed combustion support air is one way into the transfer chamber and stored therein during substantially the entire second reciprocal exhaust stroke of the piston.

3. The heat engine cycle as set forth in claim 1, wherein admitting of intake air is one way into the compression chamber during the second reciprocal exhaust stroke of the piston.

4. The heat engine cycle as set forth in claim 1, wherein charging of compressed combustion support air is one way into the transfer chamber and stored therein during substantially the entire second reciprocal exhaust stroke of the piston, wherein transfer of compressed combustion support air is one way into the combustion chamber during the initial portion of the first power stroke of the piston, and wherein admitting of intake air is one way into the compression chamber continuously during the entire second reciprocal exhaust stroke of the piston.

5. The heat engine cycle as set forth in claim 1, wherein transferring of compressed combustion support air is stopped at a substantially advanced position during the initial portion of the first power stroke of the piston at which position igniting the admixture is by spark.

6. The heat engine cycle as set forth in claim 1, wherein injecting of fuel is into the combustion chamber during the transferring of said a portion of the compressed combustion support air therein.

7. The heat engine cycle as set forth in claim 6, wherein transferring of compressed combustion support air is stopped at a substantially advanced position during the initial portion of the first power stroke of the piston at which position igniting the admixture is by spark.

8. The heat engine cycle as set forth in claim 1, wherein transfer of compressed combustion support air is one way into the combustion chamber during substantially the entire initial portion of the first power stroke of the piston, and wherein injecting of fuel is into the combustion chamber during the transferring of said a portion of the compressed combustion air therein.

9. The heat engine cycle as set forth in claim 8, wherein transferring of compressed combustion support air is stopped at a substantially advanced position during the initial portion of the first power stroke of the piston at which position igniting the admixture is by spark.

10. The heat engine cycle as set forth in claim 1, wherein transferring of compressed combustion support air is stopped at a substantially advanced position during the initial portion of the first power stroke of the piston, and wherein injecting of fuel commences at said advanced position of the piston and at which position igniting of the admixture is by spark.

11. The heat engine cycle as set forth in claim 10, wherein injecting of fuel continues during a substantial portion of the first power stroke of the piston.

12. The heat engine cycle as set forth in claim 10, wherein the injecting of fuel is by constant volume variable potency continuing during a substantial portion of the first power stroke of the piston.

* * * * *